US008795000B2

(12) United States Patent
Sugimoto

(10) Patent No.: US 8,795,000 B2
(45) Date of Patent: Aug. 5, 2014

(54) ELECTRICAL CONNECTOR WITH A RETAINER

(75) Inventor: Shinpei Sugimoto, Yokkaichi (JP)

(73) Assignee: Sumitomo Wiring Systems Ltd., Yokkaichi (JP)

( * ) Notice: Subject to any disclaimer, the term of this patent is extended or adjusted under 35 U.S.C. 154(b) by 21 days.

(21) Appl. No.: 13/352,459

(22) Filed: Jan. 18, 2012

(65) Prior Publication Data

US 2012/0196470 A1 Aug. 2, 2012

(30) Foreign Application Priority Data

Jan. 27, 2011 (JP) ..... 2011-015090

(51) Int. Cl.
*H01R 13/40* (2006.01)

(52) U.S. Cl.
USPC ..... 439/595; 439/752

(58) Field of Classification Search
USPC ..... 439/345, 595, 752, 752.5, 757, 598
See application file for complete search history.

(56) References Cited

U.S. PATENT DOCUMENTS 5,127,854 A 7/1992 Fujitani et al.
5,529,515 A * 6/1996 Ohtaka et al. ..... 439/595
5,730,625 A 3/1998 Sikora
5,746,624 A * 5/1998 Ohsumi et al. ..... 439/595
5,769,664 A * 6/1998 Saito et al. ..... 439/595
6,716,069 B2 * 4/2004 Nakamura et al. ..... 439/752
6,764,352 B2 * 7/2004 Tsuji ..... 439/752
6,811,437 B2 * 11/2004 Nimura ..... 439/595
6,926,556 B2 * 8/2005 Tsuji ..... 439/595
7,097,503 B2 * 8/2006 Tsuji ..... 439/595
2002/0031947 A1 3/2002 Gundermann et al.
2005/0085138 A1 4/2005 Tsuji

FOREIGN PATENT DOCUMENTS

JP 09-283203 10/1997

* cited by examiner

*Primary Examiner* — Hae Moon Hyeon
(74) *Attorney, Agent, or Firm* — Gerald E Hespos; Michael J Porco; Matthew T Hespos

(57) ABSTRACT

A housing (10) includes locking lances (15A, 15B) for retaining terminal fittings (30) inserted into terminal accommodating chambers (11A, 11B) arranged side by side in upper and lower levels and deformation spaces (16A, 16B) extending in an arrangement direction of the locking lances (15A, 15B) and allowing the locking lances 15A, 15B to be resiliently deformed away from the terminal fittings (30). When deformation preventing portions (41A, 41B) of a retainer (40) are inserted into the deformation spaces (16A, 16B), the locking lances (15A, 15B) are prevented from being deformed away from the terminal fittings (30). The retainer (40) includes a rectangular tube (45) formed by the two deformation preventing portions (41A, 41B) and two couplings (44) coupling the deformation preventing portions (41A, 41B), and the housing (10) includes accommodating portions (18) for accommodating the couplings (44).

13 Claims, 8 Drawing Sheets

ELECTRICAL CONNECTOR WITH A RETAINER

BACKGROUND OF THE INVENTION

1. Field of the Invention

The present invention relates to a connector.

2. Description of the Related Art

Japanese Unexamined Patent Publication No. H09-283203 discloses a connector with a housing that has terminal accommodating chambers arranged side by side in upper and lower levels. Locking lances project into the terminal accommodating chambers. Upper and lower deformation spaces extend in an arrangement direction of the locking lances and allow the locking lances to be deformed away from the terminal accommodating chambers. Terminal fittings are inserted into the housing from behind and cause the locking lances to deform into the deformation spaces. The locking lances then return resiliently to engage the terminal fittings and retain the terminal fittings in the terminal accommodating chambers. A retainer is mounted into the housing from the front and includes upper and lower deformation preventing portions that can be inserted into the upper and lower deformation spaces to prevent the locking lances from being deformed away from the terminal fittings.

The deformation preventing portions are in the deformation spaces when all of the terminal fittings are inserted properly. Thus, the locking lances cannot deform and the terminal fittings are retained reliably. Any insufficiently inserted terminal fitting will prevent the locking lance from resiliently returning and the deformed locking lance associated with the insufficiently inserted terminal fitting will remain in the deformation space. As a result, the deformation preventing portion cannot enter the deformation space and the presence of the insufficiently inserted terminal fitting can be detected.

The upper and lower deformation preventing portions of the retainer are plates that cantilever from a front wall. Thus, the retainer has low rigidity and easily can be deformed improperly. Deformation can adversely affect functions of retaining the terminal fittings and detecting insufficiently inserted terminal fittings.

The invention was completed in view of the above situation and an object thereof is to improve the rigidity of a retainer.

SUMMARY OF THE INVENTION

The invention relates to a connector with a housing that has terminal accommodating chambers arranged side by side in a plurality of rows. Locking lances are formed in the housing and project into the terminal accommodating chambers. Deformation spaces are formed in the housing and extend in an arrangement direction of the locking lances to allow the locking lances to be deformed away from the terminal accommodating chambers. Terminal fittings can be inserted into the terminal accommodating chambers from an insertion side and cause the locking lances to deform into the deformation spaces. The locking lances return resiliently when the terminal fittings have been inserted properly and engage the terminal fittings to hold the terminal fittings in the terminal accommodating chambers. A retainer is mounted into the housing in a mounting direction and has deformation preventing portions that can enter the deformation spaces to prevent the locking lances from being deformed away from the terminal fittings. The retainer includes a tube formed by at least part of the deformation preventing portions and at least part of couplings that couple the deformation preventing portions. The housing has at least one accommodating portion capable of accommodating the couplings.

The deformation preventing portions are not cantilevered, but rather form part of the tube coupled by the couplings. Therefore, rigidity of the retainer is increased.

The mounting direction of the retainer into the housing preferably is substantially opposite to an insertion direction of the terminal fittings into the housing.

Areas before the locking lances in the housing preferably serve as mold removal spaces that are open toward the front surface of the housing.

Closing portions preferably project from the deformation preventing portions of the retainer and can at least partly close the mold removal spaces. Thus, external matter cannot enter the housing through the mold removal spaces.

The accommodating portion and the couplings preferably are formed with engaging portions that are parallel to the mounting direction of the retainer into the housing and slidably engage each other when the retainer is mounted.

The engaging portions of the retainer and the housing preferably engage one another in the process of mounting the retainer into the housing to stabilize the posture of the retainer relative to the housing. The engaging portion of the retainer preferably is formed on the highly rigid tube. Thus, a posture stabilizing function has excellent reliability.

The engaging portions preferably comprise ribs that engage with grooves. The ribs and/or the grooves preferably extend substantially continuously from the front ends to the rear ends of the accommodating portions and straight in a direction parallel to the mounting direction of the retainer into the housing.

The retainer preferably is formed with a resiliently deformable lock cantilevered from the tube.

The lock preferably is resiliently deformed by interference with by a receiving portion of the housing in the process of mounting the retainer into the housing. The lock engages the receiving portion when the retainer is mounted in the housing to hold the retainer in the housing. The cantilevered lock is deformed easily when mounting the retainer to provide good operational efficiency.

The locking lance will remain in the deformation space if the respective terminal fitting is not inserted sufficiently. As a result, the respective deformation preventing portion will contact the locking lance that remains in the deformation space and will prevent the retainer from being mounted any further.

These and other objects, features and advantages of the invention will become more apparent upon reading the following detailed description of preferred embodiments and accompanying drawings.

DETAILED DESCRIPTION OF THE PREFERRED EMBODIMENTS

Figure 1:
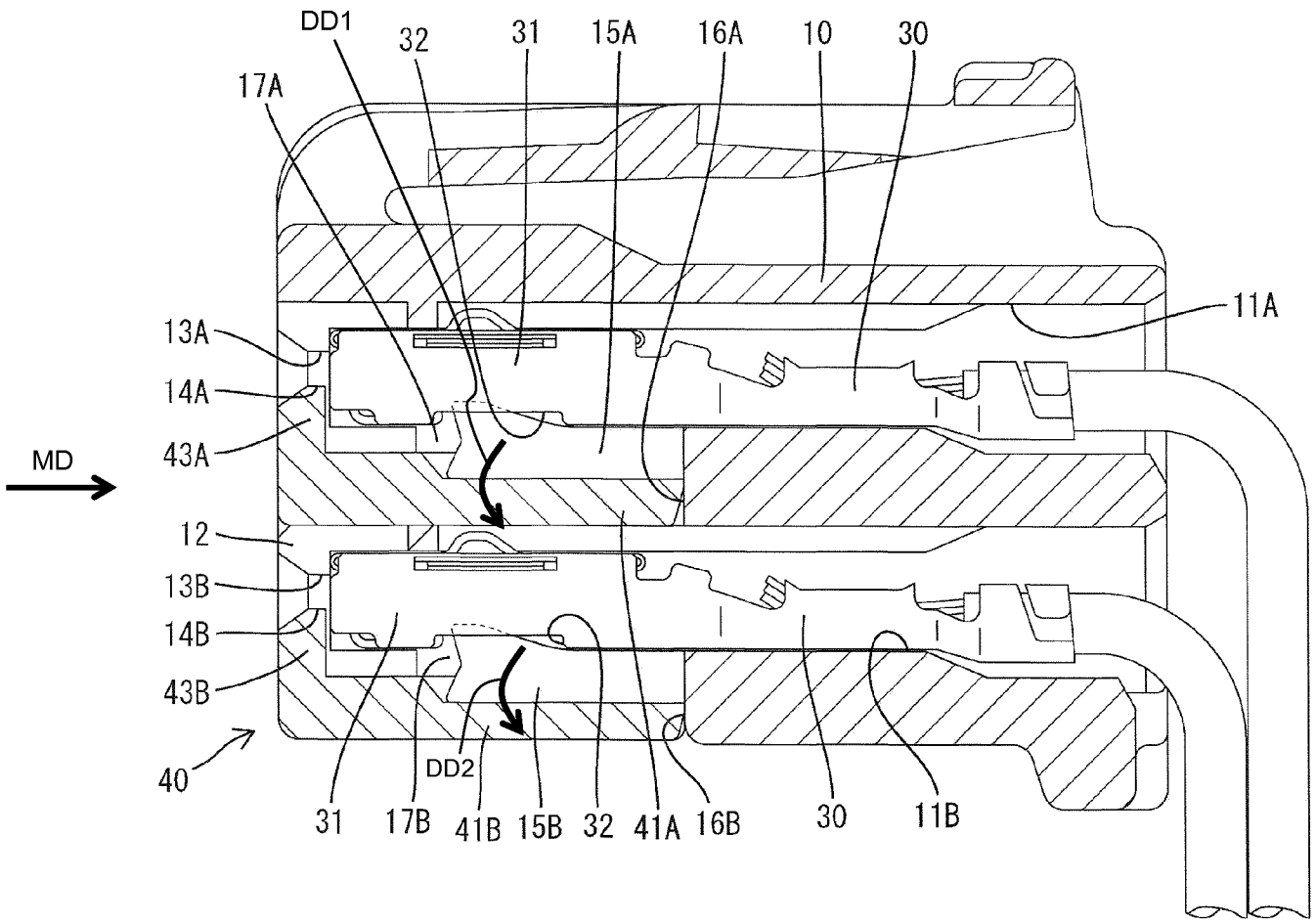
FIG. 1 is a section of a connector in accordance with the invention.
Figure 2:
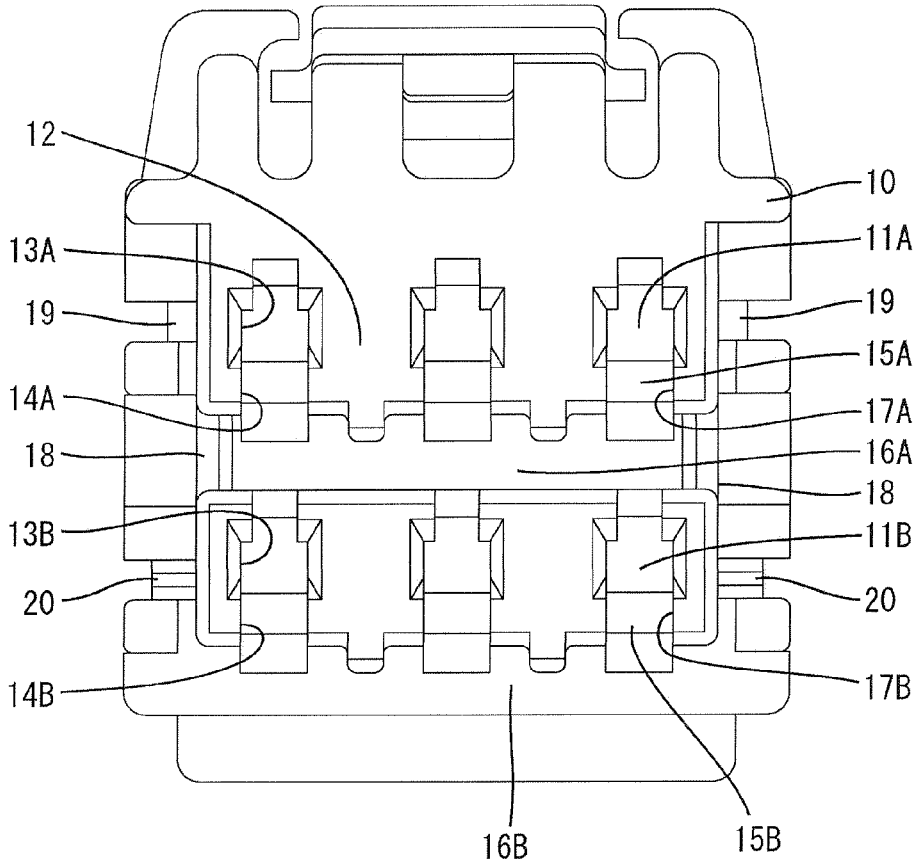
FIG. 2 is a front view of a housing of the connector.
Figure 3:
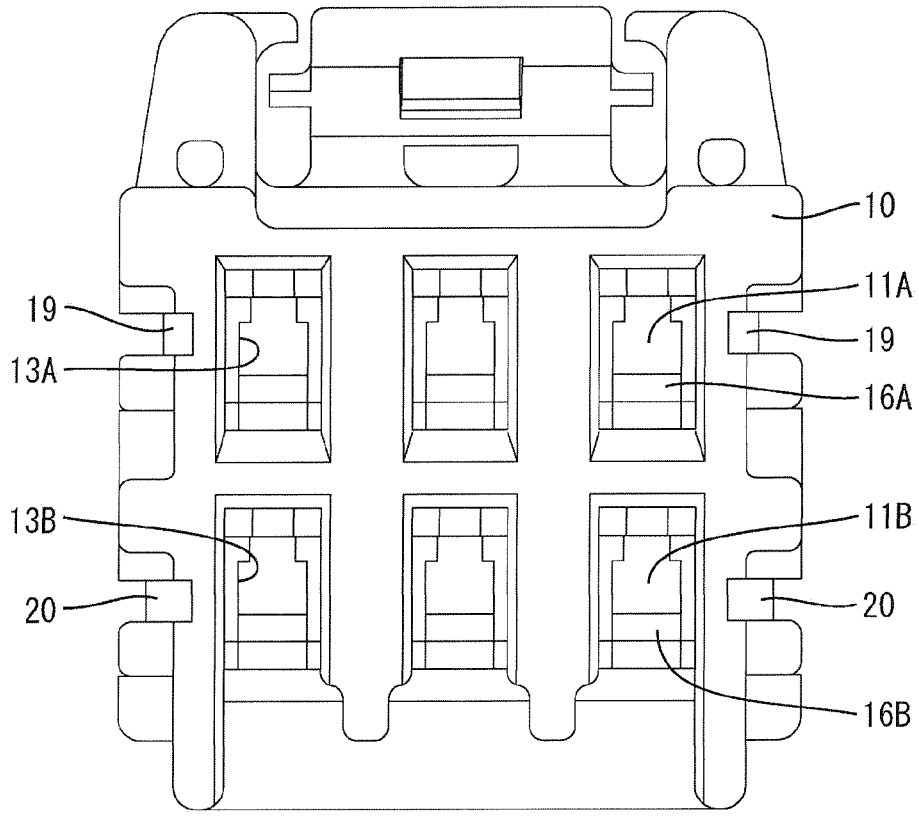
FIG. 3 is a rear view of the housing.
Figure 4:
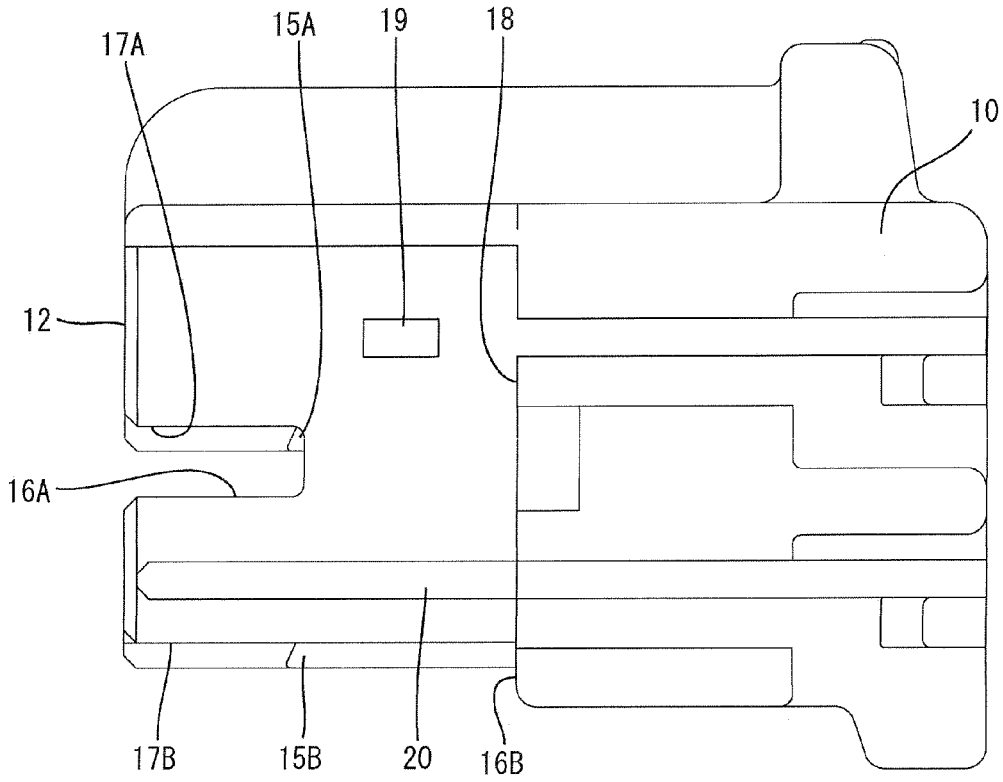
FIG. 4 is a side view of the housing.
Figure 5:
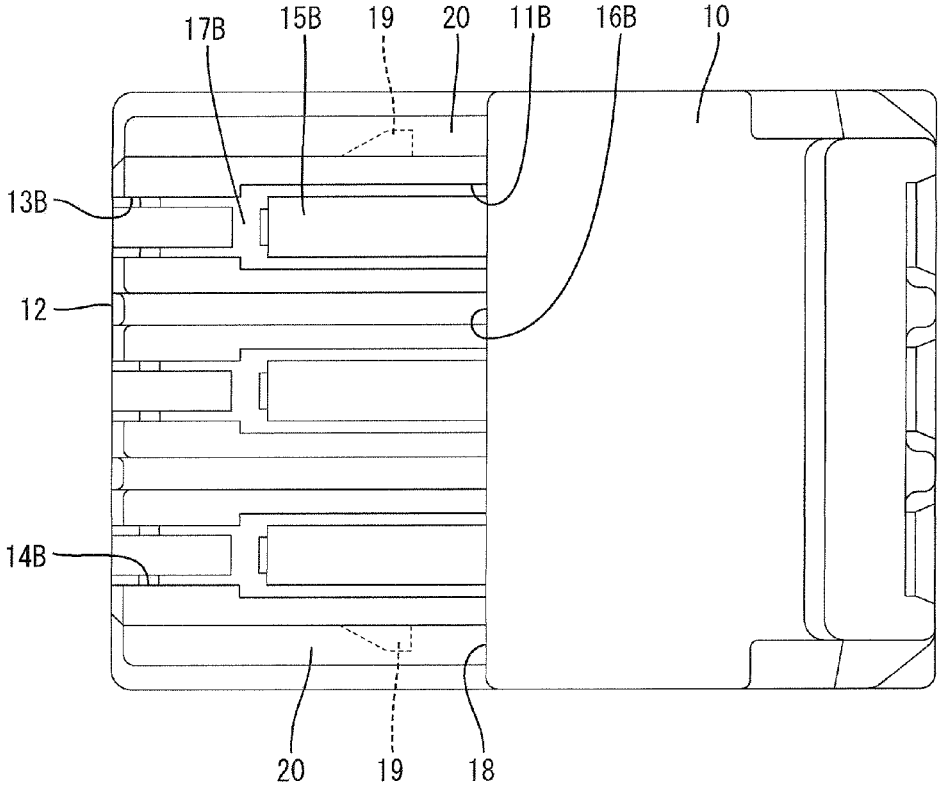
FIG. 5 is a bottom view of the housing.
Figure 6:
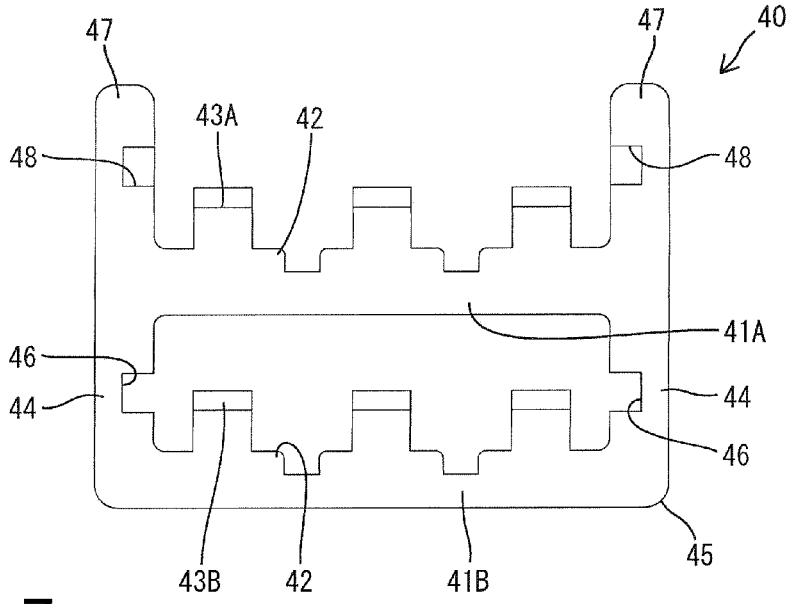
FIG. 6 is a front view of a retainer of the connector.
Figure 7:
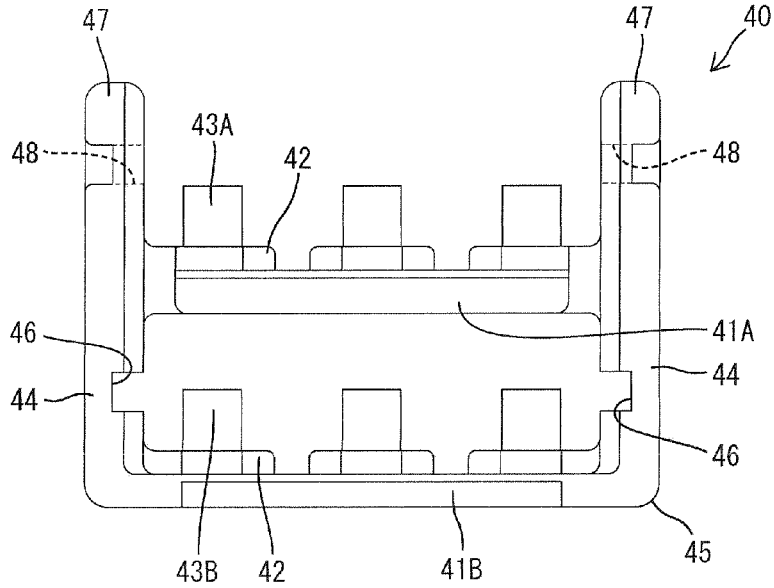
FIG. 7 is a rear view of the retainer.
Figure 8:
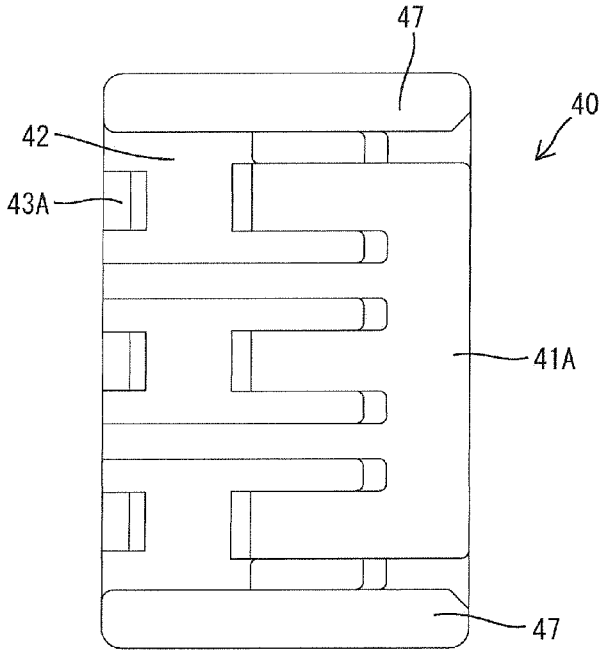
FIG. 8 is a plan view of the retainer.
Figure 9:
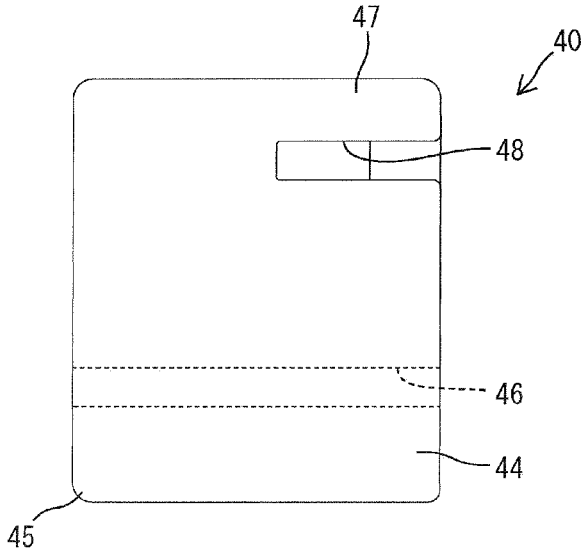
FIG. 9 is a side view of the retainer.
Figure 10:
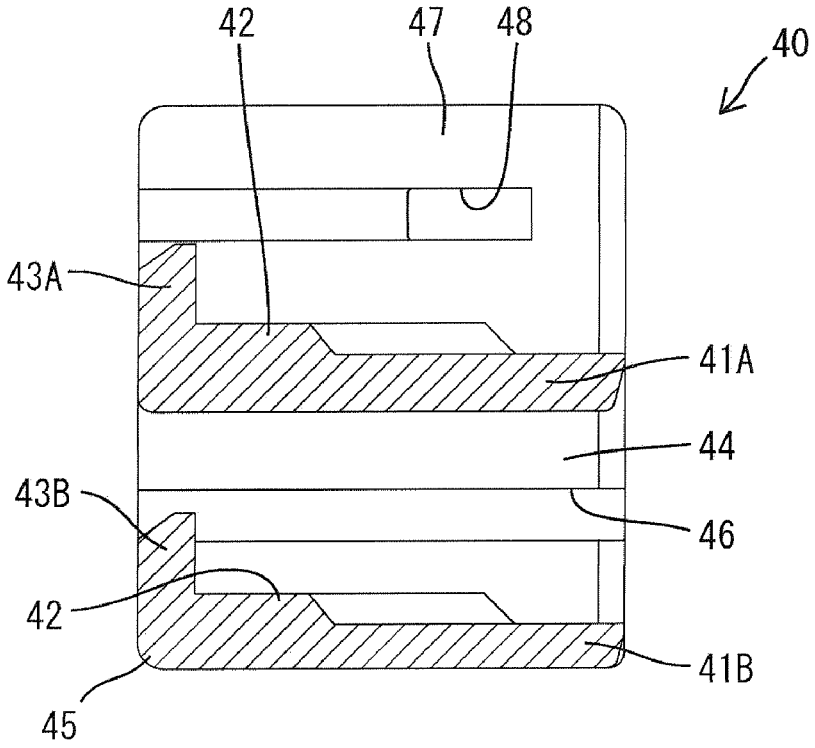
FIG. 10 is a section of the retainer.

A connector in accordance with the invention is shown in FIG. 1 and includes a housing identified generally by the numeral 10. The housing 10 is made e.g. of synthetic resin and, as shown in FIGS. 2 to 5, is a substantially bilaterally symmetrical block. Upper and lower terminal accommodating chambers 11A, 11B penetrate through the housing 10 in forward and backward directions and are arranged side by side at upper and lower levels. The housing 10 has a front wall 12 with substantially rectangular upper tab insertion openings 13A that communicate with the upper terminal accommodating chambers 11A, upper cutouts 14A that communicate with lower sides of the opening edges of the upper tab insertion openings 13A, substantially rectangular lower tab insertion openings 13B that communicate with the lower terminal accommodating chambers 11B and lower cutouts 14B that communicate with lower sides of the opening edges of the lower tab insertion openings 13B.

A upper locking lance 15A is cantilevered along the upper surface of each upper terminal accommodating chamber 11A and is resiliently deformable down in a deformation direction DD1 and away from the upper terminal accommodating chamber 11A. Similarly, a lower locking lance 15B is cantilevered along the upper surface of each lower terminal accommodating chamber 11B and is resiliently deformable down in a deformation direction DD2 away from the lower terminal accommodating chamber 11B.

The housing 10 is formed with an upper deformation space 16A extending from the rear end of a deformation area for the upper locking lances 15A toward the front end of the housing 10 and is open toward the front surface of the housing 10. A front end of the upper deformation space 16A communicates with the upper cutouts 14A. The upper deformation space 16A extends over the entire formation area of the laterally arranged upper locking lances 15A and penetrates laterally through the housing 10 to open toward the left and right outer side surfaces of the housing 10. An area of the upper deformation space 16A below the upper locking lances 15A defines a deformation allowing area for allowing the upper locking lances 15A to be deformed resiliently down in the deformation direction DD1 away the lower terminal accommodating chambers 11A.

The housing 10 also is formed with a lower deformation space 16B extending from the rear end of a deformation area for the lower locking lances 15B to the front end of the housing 10 and opens toward the front surface of the housing 10. A front end portion of the lower deformation space 16B communicates with the lower cutouts 14B. The lower deformation space 16B extends over the entire formation area of the laterally arranged lower locking lances 15B and penetrates laterally through the housing 10 to open toward the left and right outer side surfaces of the housing 10 and also toward the bottom surface. An area of the lower deformation space 16B below the lower locking lances 15B defines a deformation allowing area for allowing the lower locking lances 15B to be deformed resiliently down in the deformation direction DD2 away from the lower terminal accommodating chambers 11B.

Upper mold removal spaces 17A extend from the upper locking lances 15A to the upper cutouts 14A at the front of the housing 10 and communicate with the upper deformation space 16A. The upper mold removal spaces 17A are removal paths for mold parts (not shown) for forming the front surfaces of the upper locking lances 15A. Lower mold removal spaces 17B extend from the lower locking lances 15B to the lower cutouts 14B at the front of the housing 10 and communicate with the lower deformation space 16B. The lower mold removal spaces 17B are removal paths for mold parts (not shown) for forming the front surfaces of the lower locking lances 15B. The upper mold removal spaces 17A communicate with front ends of the upper terminal accommodating chambers 11A and the lower mold removal spaces 17B communicate with front ends of the lower terminal accommodating chambers 11B. The mold removal spaces 17A, 17B and the cutouts 14A, 14B fulfill no function after the housing 10 is formed.

Bilaterally symmetrical accommodating recesses 18 are formed at front areas of the left and right outer side surfaces of the housing 10 and open toward the front, lateral and bottom of the housing 10 and bilaterally symmetrical receiving projections 19 are formed in the respective accommodating recesses 18. The receiving projections 19 are arranged at positions near the rear ends of the accommodating portions 18 in forward and backward directions and are above and adjacent the upper deformation space 16A in a vertical direction. Similarly, bilaterally symmetrical ribs 20 extend straight and continuously from the front ends to the rear ends of the accommodating recesses 18 at positions between the upper and lower deformation spaces 16A, 16B in the vertical direction.

Terminal fittings 30 can be inserted into the terminal accommodating chambers 11A, 11B of the housing 10 from behind. Each terminal fitting 30 is a female terminal and has a rectangular tubular connecting portion 31 at its front end. A retaining recess 32 is formed in the lower surface of the connecting portion 31. The locking lances 15A, 15B interfere with the connecting portions 31 in the process of inserting the terminal fittings 30 and deform down in the deformation direction DD1, DD2 to enter the deformation spaces 16A, 16B. However, the locking lances 15A, 15B resiliently return up toward the terminal accommodating chambers 11A, 11B when the terminal fittings 30 reach proper insertion positions and the locking lances 15A, 15B engage the retaining recesses 32 to lock the terminal fittings 30. The mold removal spaces 17A, 17B communicate with the bottom surfaces of the front portions of the terminal accommodating chambers 11A, 11B. However, the opening width of these communicating parts is narrower than the width of the connecting portions 31. Thus, front portions of the terminal fittings 30 do not fall into the mold removal spaces 17A, 17B.

The connector also includes a retainer 40 that is made unitarily of synthetic resin and is substantially bilaterally symmetrical. As shown in FIGS. 6 to 10, the retainer 40 has upper and lower deformation preventing portions 41A, 41B that can fit into the deformation spaces 16A, 16B, couplings 44 that can be accommodated in the accommodating portions 18, and locks 47 that can be accommodated in the accommodating portions 18.

The upper and lower deformation preventing portions 41A and 41B are plates that are parallel to a mounting direction MD of the retainer 40 into the housing 10. Elevated portions 42 are formed in areas of the upper surfaces of the deformation preventing portions 41A, 41B not corresponding to the lower surfaces of the locking lances 15A, 15B when the retainer 40 is mounted in the housing 10 and are elevated relative to areas corresponding to the lower surfaces of the locking lances 15A, 15B to form steps. Upper closing portions 43A project up from the upper surfaces of the elevated portions 42 at a front end of the upper deformation preventing portion 41A and are arranged laterally side by side to correspond to the upper cutouts 14A. Lower closing portions 43B project up from the upper surfaces of the elevated portions 42 at a front end of the lower deformation preventing portion 41B and are arranged laterally side by side to correspond to the lower cutouts 14B.

Left and right end edges of the upper and lower deformation preventing portion 41A and 41B are coupled by couplings 44, which are substantial flat plates aligned parallel to the mounting direction MD of the retainer 40 into the housing 10 and substantially perpendicular to the deformation preventing portions 41A, 41B. The upper and lower deformation preventing portions 41A, 41B and the left and right couplings 44 form a substantially rectangular tube 45 with open front and rear ends. The front surfaces of the deformation preventing portions 41A, 41B and the couplings 44 are substantially continuous and flush with each other, and the rear surfaces of the deformation preventing portions 41A, 41B and the couplings 44 are substantially continuous and flush with each other. Inner surfaces of the left and right couplings 44 are recessed to form substantially straight grooves 46 extending parallel to the mounting direction MD of the retainer 40 into the housing 10. The grooves 46 extend continuously from the rear ends to the front ends of the couplings 44 and are open toward the rear and front ends of the couplings 44.

The left and right locks 47 are substantially flat plates that cantilever up from corners of the rectangular tube 45 where the left and right ends of the upper deformation preventing portion 41A and upper ends of the left and right couplings 44 meet at substantially right angles. The locks 47 are substantially flush with the couplings 44 and parallel to the mounting direction MD of the retainer 40 into the housing 10. The front surfaces of the locks 47 are substantially continuous and flush with the front surfaces of the upper deformation preventing portion 41A and the couplings 44, and the rear surfaces thereof are substantially continuous and flush with the rear surfaces of the upper deformation preventing portion 41A and the couplings 44. The locks 47 are resiliently deformable in the lateral direction relative to the rectangular tube 45 about their lower ends connected to the rectangular tube 45. The left and right locks 47 are formed with locking recesses 48 that penetrate through the locks 47 in a thickness direction.

The retainer 40 is detached from the housing 10 before inserting the terminal fittings 30 into the housing 10. The terminal fittings 30 then are inserted into the terminal accommodating chambers 11A, 11B from behind. The locking lances 15A, 15B interfere with the connecting portions 31 of the terminal fittings 30 in the insertion process and deform into the deformation spaces 16A, 16B adjacent thereto. However, the locking lances 15A, 15B resiliently return to engage the retaining portions 32 when the terminal fittings 30 reach the proper insertion positions in contact with the front wall 12. Thus, the terminal fittings 30 are held and prevented from coming out backward.

The retainer 40 is mounted into the housing 10 from the front and along the mounting direction MD after all of the terminal fittings 30 are inserted. The mounting direction MD of the retainer 40 is opposite to the inserting direction of the terminal fittings 30 in forward and backward directions. In mounting the retainer 40, the upper and lower deformation preventing portions 41A, 41B are inserted respectively into the upper and lower deformation spaces 16A, 16B. Additionally, the grooves 46 engage the ribs 20 and slide in contact therewith. The grooves 46 and the ribs 20 gradually engage over a longer length as the retainer 40 is mounted more so that the posture of the retainer 40 relative to the housing 10 becomes gradually more stable. That is, there is no likelihood of vertically inclining the posture of the retainer 40 relative to the housing 10.

All of the locking lances 15A, 15B resiliently return from the deformation spaces 16A, 16B to engage the terminal fittings 30 if all of the terminal fittings 30 are inserted properly. Thus, the upper deformation preventing portion 41A fits into the upper deformation space 16A to oppose the lower surfaces of the upper locking lances 15A and the lower deformation preventing portion 41B fits into the lower deformation space 16B to oppose the lower surfaces of the lower locking lances 15B as the retainer 40 is mounted.

The couplings 44 couple the upper and lower deformation preventing portions 41A, 41B to form the highly rigid rectangular tube 45 that will not deform in the vertical direction. Further, the grooves 46 engage the ribs 20 to prevent vertical inclination of the couplings 44. Accordingly, the deformation preventing portions 41A, 41B reliably fit into the deformation spaces 16A, 16B without contacting the locking lances 15A, 15B.

The rear end edges of the locks 47 interfere with the receiving projections 19. Thus, the locks 47 deform away from each other as the retainer 40 is mounted. The cantilevered locks 47 deform easily so that resistance produced in mounting the retainer 40 due to resilient deformation of the locking portions 47 is suppressed to a minimum. The locks 47 resiliently return when the retainer 40 reaches a properly mounted state so that the locking holes 48 engage the receiving projections 19. Therefore, the retainer 40 is locked in the properly mounted state in the housing 10.

The upper and lower deformation preventing portions 41A, 41B are inserted deeply in the respective upper and lower deformation spaces 16A, 16B with the retainer 40 properly mounted. Thus, the upper and lower locking lances 15A, 15B cannot deform down in an unlocking direction to separate from the terminal fittings 30 and allow the terminal fittings 30 to come out backward. By preventing deformation of the locking lances 15A, 15B in this way, all the terminal fittings 30 are reliably held and retained.

The closing portions 43A, 43B fit in and close the opening areas of the cutouts 14A, 14B in the front surface of the housing 10 when the retainer 40 is mounted properly. In this way, only minimum necessary tab insertion openings 13A, 13B are left in the front wall 12 of the housing 10 so that external matter is unlikely to enter the housing 10 from the front.

One of the terminal fittings 30 may be inserted insufficiently when the retainer 40 is mounted. Thus, the locking lance 15A, 15B interfering with the connecting portion 31 of this insufficiently inserted terminal fitting 30 remains in the deformation space 16A, 16B. Accordingly, the rear end of the deformation preventing portion 41A, 41B will contact the front end of the locking lance 15A, 15B to prevent further mounting of the retainer 40. The presence of the insufficiently inserted terminal fitting 30 can be detected by the inability to mount the retainer 40.

The engagement of the grooves 46 and the ribs 20 and the rigidity of the rectangular tube 45 ensure that the retainer 40 while being mounted into the housing 10. Thus, the deformation preventing portion 41A, 41B will reliably contact any locking lance 15A, 15B that is located in the deformation space 16A, 16B. Therefore, an insufficient insertion detecting function has excellent reliability.

The retainer 40 includes the rectangular tube 45 formed by the upper and lower deformation preventing portions 41A, 41B and the left and right couplings 44 coupling the deformation preventing portions 41A, 41B. The housing 10 is formed with the accommodating portions 18 capable of accommodating the couplings 44. According to this construction, the upper and lower deformation preventing portions 41A, 41B coupled by the coupled by the couplings 44 form the highly rigid rectangular tube 45 instead of extending in a cantilever manner. Thus, the rigidity of the retainer 40 is increased.

Mold removal spaces 17A, 17B are formed in areas of the housing 10 before the locking lances 15A, 15B and open toward the front surface of the housing 10. The closing portions 43A, 43B project from the deformation preventing portions 41A, 41B of the retainer 10 and can close the mold removal spaces 17A, 17B. Accordingly, external matter cannot enter the housing 10 through the mold removal spaces 17A, 17B when the retainer is mounted to the housing 10.

The accommodating portions 18 and the couplings 44 are formed with the ribs 20 and the grooves 46 that extend parallel to the mounting direction MD of the retainer 40 into the housing 10 and slidably engage each other when the retainer 40 is mounted. Accordingly, the posture of the retainer 40 relative to the housing 10 is stable in the process of mounting the retainer 40 into the housing 10. Further, the grooves 46 are formed on the highly rigid rectangular tube 45 of the retainer 40 to provide a posture stabilizing function that has excellent reliability.

The invention is not limited to the above described and illustrated embodiment. For example, the following embodiments also are included in the scope of the invention.

The couplings are at opposite ends of the deformation preventing portions in the above embodiment. However, the couplings may couple the deformation preventing portions at positions other than the opposite ends (e.g. widthwise intermediate positions).

The deformation preventing portions are coupled by two couplings in the above embodiment. However, they may be coupled by three or more couplings arranged in the width direction so that plural rectangular tubes are formed.

The accommodating portions are open toward the front surface of the housing and the outer side surfaces of the housing in the above embodiment. However, the accommodating portions may be open only toward the front surface of the housing without being open toward the outer side surfaces of the housing.

The deformation space in the lower level is open toward the bottom surface of the housing substantially in the above embodiment, but it may be open only toward the front surface of the housing without being open toward the bottom surface of the housing.

The retainer is detached from the housing in the process of inserting the terminal fittings into the housing in the above embodiment. However, it may be mounted at a partial locking position in the housing that allows the insertion of the terminal fittings into the housing and the resilient deformation of the locking lances.

The space enclosed by the rectangular tube is open toward the front in the above embodiment, but the front end of the rectangular tube may be closed by a front wall.

The mold removal spaces for the locking lances are closed by the closing portions of the retainer in the above embodiment, but they may be open toward the front surface of the housing even with the retainer mounted.

The grooves of the retainer are formed on the rectangular tube in the above embodiment, but they may be formed on a part other than the rectangular tube.

In the above embodiment, the engaging portions of the retainer are grooves and those of the housing are projections. Conversely, the engaging portions of the housing may be grooves and those of the retainer may be projections.

The terminal accommodating chambers are in upper and lower levels and there are two deformation preventing portions in the above embodiment. However, the invention can be applied with terminal accommodating chambers in three or more rows.

What is claimed is:

1. A connector, comprising:

a housing including terminal accommodating chambers arranged substantially side by side in at least first and second rows in the housing, at least first and second rows of locking lances projecting respectively into the terminal accommodating chambers, first and second rows of deformation spaces disposed to allow the locking lances of the first and second rows of locking lances to deform in a direction away from the respective terminal accommodating chambers;

terminal fittings inserted into the terminal accommodating chambers and locked in the terminal accommodating chambers by the locking lances; and a retainer mounted into the housing in a mounting direction, the retainer including at least first and second deformation preventing plates, each of the deformation preventing plates having opposite front and rear ends and opposite left and right sides extending between the front and rear ends, and left and right couplings coupled respectively to the left and right sides of the deformation preventing plates from the front end toward the rear end of each of the deformation preventing plates to define a substantially rectangular tube, the rear end of the first deformation preventing plate, including a part of the rectangular tube, being insertable into all of the deformation spaces in the first row of deformation spaces, and the rear end of the second deformation preventing plate, including a part of the rectangular tube, being insertable into all of the deformation spaces in the second row of deformation spaces, whereby the first and second deformation preventing plates prevent the locking lances at the first and second rows of locking lances from being resiliently deformed in the direction away from the terminal fittings.

2. The connector of claim 1, wherein the housing is formed with accommodating recesses capable accommodating the couplings.

3. The connector of claim 1, wherein the mounting direction of the retainer into the housing is substantially opposite to an insertion direction of the terminal fittings into the housing.

4. The connector according of claim 3, wherein the housing includes mold removal spaces that are open between the locking lances and a front surface of the housing.

5. The connector of claim 4, wherein the retainer is formed with closing portions projecting from the deformation preventing plates and configured for closing the mold removal spaces.

6. The connector of claim 2, wherein the accommodating recesses are formed with ribs extending the mounting direction and the couplings are formed with inwardly facing grooves aligned parallel to the mounting direction of the retainer into the housing, the ribs being slidably engaged with the grooves when the retainer is mounted.

7. The connector of claim 6, wherein the ribs extend substantially continuously from front ends to rear ends of the accommodating recesses and are straight and parallel to the mounting direction of the retainer.

8. The connector of claim 1, wherein the retainer is formed with a resiliently deformable lock cantilevered from the rectangular tube.

9. The connector of claim 8, wherein the lock is resiliently deformed by interference with a receiving portion of the housing in the process of mounting the retainer into the housing.

10. The connector of claim 9, wherein the lock engages the receiving portion with the retainer mounted in the housing to hold the retainer in the housing.

11. The connector of claim 1, wherein the respective deformation preventing plates are configured to contact any of the locking lances that remains in the respective deformation space due to an insufficiently inserted one of the terminal fittings to prevent the retainer from being mounted any further.

12. The connector of claim 1, wherein the rear ends of the deformation plates align with rear ends of the couplings.

13. The connector of claim 1, wherein the rear ends of the deformation plates are substantially linear in a direction transverse to the mounting direction.

* * * * *